United States Patent [19]

Blundy et al.

[11] Patent Number: 4,920,899

[45] Date of Patent: May 1, 1990

[54] MODULAR FURNACE AND METHODS OF REPAIRING SAME

[75] Inventors: Robert F. Blundy, Columbia, S.C.; Charles E. Dunbar, Pelion, both of S.C.

[73] Assignee: American Telephone and Telegraph Company, New York, N.Y.

[21] Appl. No.: 360,506

[22] Filed: Jun. 2, 1989

[51] Int. Cl.[5] ..... F23M 5/00

[52] U.S. Cl. ..... 110/336; 264/30; 266/281; 432/248

[58] Field of Search ..... 264/30; 432/248, 264; 266/281, 283; 110/336

[56] References Cited

U.S. PATENT DOCUMENTS

| | | | |
|---|---|---|---|
| 3,302,352 | 2/1967 | Flexon et al. | 110/336 X |
| 3,403,213 | 9/1968 | Taylor et al. | 264/30 X |
| 3,805,466 | 4/1974 | Van Laar et al. | 110/336 X |
| 4,017,960 | 4/1977 | Kwabe et al. . | |
| 4,151,693 | 5/1979 | Harvey . | |
| 4,291,514 | 9/1981 | Harvey . | |
| 4,389,189 | 6/1983 | Harvey et al. . | |
| 4,446,082 | 5/1984 | Harvey et al. . | |
| 4,452,749 | 6/1984 | Kolvek et al. . | |
| 4,465,648 | 8/1984 | Kiriyama . | |
| 4,481,024 | 11/1984 | Bly . | |
| 4,529,178 | 7/1985 | Hosbein et al. . | |
| 4,740,155 | 4/1988 | Labas | 110/336 X |
| 4,779,798 | 10/1988 | Natolino et al. . | |

*Primary Examiner*—Edward G. Favors

*Attorney, Agent, or Firm*—Wallace C. Bair

[57] ABSTRACT

A refractory furnace (10) is constructed to facilitate repair of worn or damaged refractory portions while the furnace is maintained at near-operating temperature. A sidewall (40) of the refractory furnace is comprised of a plurality of modular sections (85) each of which includes a refractory lining (87). One or more modular sections may be selectively replaced when becoming worn or damaged. Replacement is accomplished by external access and removal of the worn or damaged modular sections.

13 Claims, 4 Drawing Sheets

MODULAR FURNACE AND METHODS OF REPAIRING SAME

TECHNICAL FIELD

This invention relates to a modular furnace and to methods of repairing same. More particularly, it relates to a furnace which facilitates removal and replacement of damaged or worn modular refractory portions thereof from the outside of the furnace.

BACKGROUND OF THE INVENTION

A refining furnace or oven structure is often constructed of refractory bricks lining the inside of a metal frame. The furnace structure includes a bottom portion comprising refractory brick and other refractory lining materials so arranged as to form a leak-tight reservoir wherein a molten metal resides. The structure also includes a roof portion and a sidewall portion. The bottom, roof and sidewall portions form the receiving volume for a refinable metal charge and isolate and insulate an interior heat source. A typical heat source is a natural gas flame.

Refractory brick is composed of various refractory oxides including magnesium, chromium, aluminum and silicon oxides which are formed in the shape of rectangular parallelepipeds. Bricks are supported by various means depending on the structure constructed. The bottom portion of the furnace structure is comprised of bricks positioned with one end exposed to the furnace interior and the other end engaging and being supported by the metal furnace frame. Bricks comprising the sidewall portion may be supported by the metal furnace frame with sufficient layers of bricks stacked one upon another to provide a desired wall height. Alternatively, wall portions may be built up from bricks with integral metal hangers attached to the metal frame over the entire height of the sidewall. Bricks comprising the roof portion may be supported with metal plates as is disclosed in U.S. Pat. No. 4,529,178, wherein, bricks supported by metal plates are hung from metal support members.

Portions of brick exposed to the heat source and molten metal are subject to corrosion, wear and mechanical damage. Extreme temperatures, corrosive slag and chemically reactive atmospheres containing, for example, sulphur, carbon monoxide and carbon dioxide and various acid fumes all act to burn away the brick material. Mechanical damage compounds with thermochemical wear and results in portions of the furnace wearing more quickly than other portions. For example, the sidewall portion of the furnace under the influence of high temperature, corrosive atmosphere and mechanical damage caused, for example, by the introduction of a furnace charge, wears more quickly than the roof portion. Wear may proceed to a point wherein the worn portion may rupture. When rupture occurs, flames originating from the interior heat source may escape, or if the rupture is below the surface of the molten charge, molten metal will leak from the furnace.

Prior art repair techniques include those where maintenance personnel enter the furnace and rebuild damaged or worn portions. The disadvantages of this method are that the entire furnace must be emptied and cooled to permit safe entry by the maintenance personnel and that the time required for the repair is lengthy. Because of the furnace's large thermal mass and a typical operating temperature in excess of 2000° F, the time required to cool the furnace can be in excess of two weeks. Other methods allow direct access to the interior of the furnace by personnel without a complete furnace cool-down. Such a method which is disclosed in U.S. Pat. No. 4,452,749 necessitates the cooling of the furnace or oven to a brick surface temperature of about 500° F. Maintenance personnel wearing protective clothing with integral cooling systems enter the oven and repair portions of the furnace brick structure. This method is potentially hazardous and requires substantial cooling and the subsequent reheating of the furnace.

Other methods of repair include those that do not require furnace entry directly by repair personnel. An external access method includes a gunning technique wherein a refractory repair material is sprayed into the damaged or worn region as disclosed in U.S. Pat. Nos. 4,779,798 and 4,465,648. Although there appears to be no requirement of furnace cool down to effect this method, use of the gunning technique results in non-uniformity of the repaired portions and shorter useful life than the original refractory material.

Another external access method is disclosed in U.S. Pat. No. 4,017,960 where a damaged portion is removed from the furnace by cutting through a steel support structure and through the damaged refractory portion. The cut is made approximately around the perimeter of the damaged or worn portion. The damaged or worn portion described is removed and replaced by a section of similar refractory material which has been cut in a shape complementary to the shape of the opening remaining in the furnace shell and refractory lining. This method disadvantageously requires a custom shaping of the section which is inserted into the opening of the furnace sidewall.

What is needed and what does not appear to be provided in the prior art is a furnace which is constructed so as to facilitate repair. Generally, the sought-after furnace should be one for which repairs may be made from outside the furnace without the need to cool down completely the furnace during such repair.

SUMMARY OF THE INVENTION

The just described problems of the prior art have been overcome with the furnace and the methods of repairing same of this invention. A furnace of this invention includes a furnace structural frame and an interior refractory lining supported by and in attachment to the furnace structural frame. The refractory lining comprises a bottom portion which forms a leakproof reservoir for containing molten material, a roof portion which is positioned above the bottom portion and a sidewall portion which is disposed between the bottom portion and the roof portion. The sidewall portion is comprised of a plurality of individual modules and is designed so as to facilitate repair of the sidewall portion by allowing selective removal and replacement of the individual modules as they become damaged or worn. The modules which may also be referred to as modular sections may be constructed of a refractory brick material attached to an external support structure. Alternatively, a cast, monolithic refractory element may be used in place of the refractory brick material. A module is replaced when excessive damage or wear has been sustained by a section of the sidewall. Evidence of this condition may be flames exiting from the sidewall, visual evidence of lost refractory material, unusually high levels of refractory impurities in the furnace's slag run-off and loss of furnace efficiency.

To effect replacement of a sidewall modular section, the furnace heat source is shut down or attenuated as required. An external lift mechanism is moved into position adjacent to the section that requires removal and is engaged therewith. A wedge shape key refractory block disposed between the modular section and the roof portion is removed by hand by a furnace rebuild technician. A mechanical securing means, located adjacent to the roof portion, which secures the sidewall modular section external support structure to the furnace structural frame, is released. The external lift mechanism is moved away from the furnace structure causing the modular section to be removed from the sidewall portion. A new or rebuilt modular section is mounted on the external lift mechanism and is repositioned in the sidewall void created by the prior modular section removal. This replacement procedure is applicable to the replacement of sidewall modular sections which utilize the refractory brick refractory elements or the cast, monolithic refractory element. Once the modular section is in place, the furnace heat source may be re-ignited or turned up to resume normal operation.

Advantageously, the furnace of this invention does not have to be cooled substantially prior to repair of replacement of the modular sections. Repair is accessed from the outside of the furnace and is therefore easier and more convenient than some other furnace repair techniques. New wall sections of materials identical to refractory materials in shape and material used in other portions of the furnace may be used for the repair instead of gunned refractory materials. This repair method can be repeated so that the entire useful lives of other portions of the furnace are realized. Long cool-down and heat-up periods are avoided along with the costs normally associated therewith.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
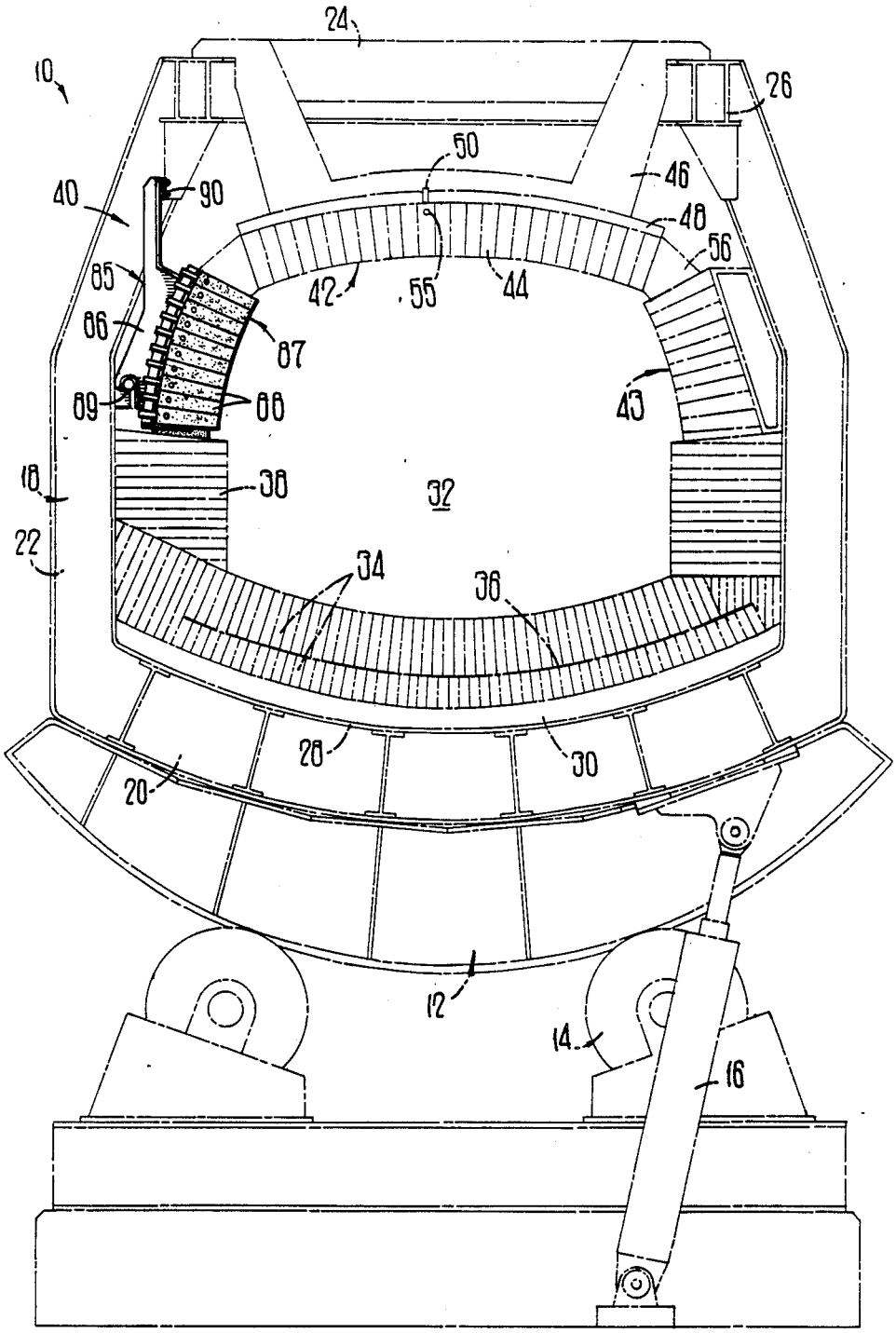
FIG. 1 is a cross sectional view of a furnace of this invention.

Referring now to FIG. 1, there is shown a refractory furnace which is designated generally by the numeral 10. As can be seen in the drawing, the furnace 10 includes a tilt follower beam 12 supported by a plurality of rollers 14-14. A hydraulic cylinder 16 actuates a tilting motion of the furnace 10 wherein the furnace 10 may be tilted to pour off a slag layer or to empty a charge of molten material contained inside the furnace.

Attached to the tilt follower beam 12 is a furnace structural frame 18 which includes a hearth frame portion 20, a plurality of side frame portions 22-22 and an upper beam portion 24. It should be understood that a plurality of furnace structural frame members 18-18 are arranged parallel to one another, spaced a predetermined distance apart and joined by perpendicularly oriented "I" beam members 26-26 to comprise a furnace structural shell.

The hearth frame portion 20 of the furnace structural frame 18 includes an arcuate surface 28. A hearth cover 30 covers the arcuate surface 28, extend, for the length of the furnace 10 and acts as a continuous support for a plurality of layers of refractory materials.

A hearth reservoir 32 is comprised of a plurality of bottom layers of refractory materials 34-34 supported by the hearth cover 30 and a plurality of hearth reservoir walls 38-38 which are supported by the refractory layers 34-34 and which extend upwards to a predetermined height. A steel liner 36 disposed between the bottom refractory layers 34-34 acts as a slip plane for the bottom refractory layers.

A sidewall portion 40 is disposed between one of the hearth reservoir walls 38-38 and a roof portion 42. Another sidewall portion 43 which is fixed is disposed between the other one of the hearth reservoir walls 38-38 and the roof portion 42. It is the sidewall portion 40 which more often is in need of repair or replacement. This may be because of possible damage thereto by a charging machine (not shown).

The roof portion 42 includes a plurality of refractory units 44-44 such as bricks, for example, attached to a roof support beam 46 along an arcuate surface 48 with a plurality of metal hangers 50-50. A metal hanger 50 is comprised of a metal bar with one end turned at 90° across a wider flat side 52 (see FIG. 6) of the bar and another end which is pierced with a brick engagement dowel 54. During assembly of the refractory portion of the roof 42, each refractory unit 44 is held in position by the engagement of a metal hanger 50 and an engagement dowel 54 with a receiving portion 55 of the refractory unit 44.

As can be seen in FIG. 1, a plurality of refractory key blocks 56-56 are disposed between the roof portion 42 and the sidewall portion 40 and between the roof portion 42 and the fixed sidewall portion 43. The key blocks 56-56 are set into position after the sidewall portions are set into position.

Figure 2:
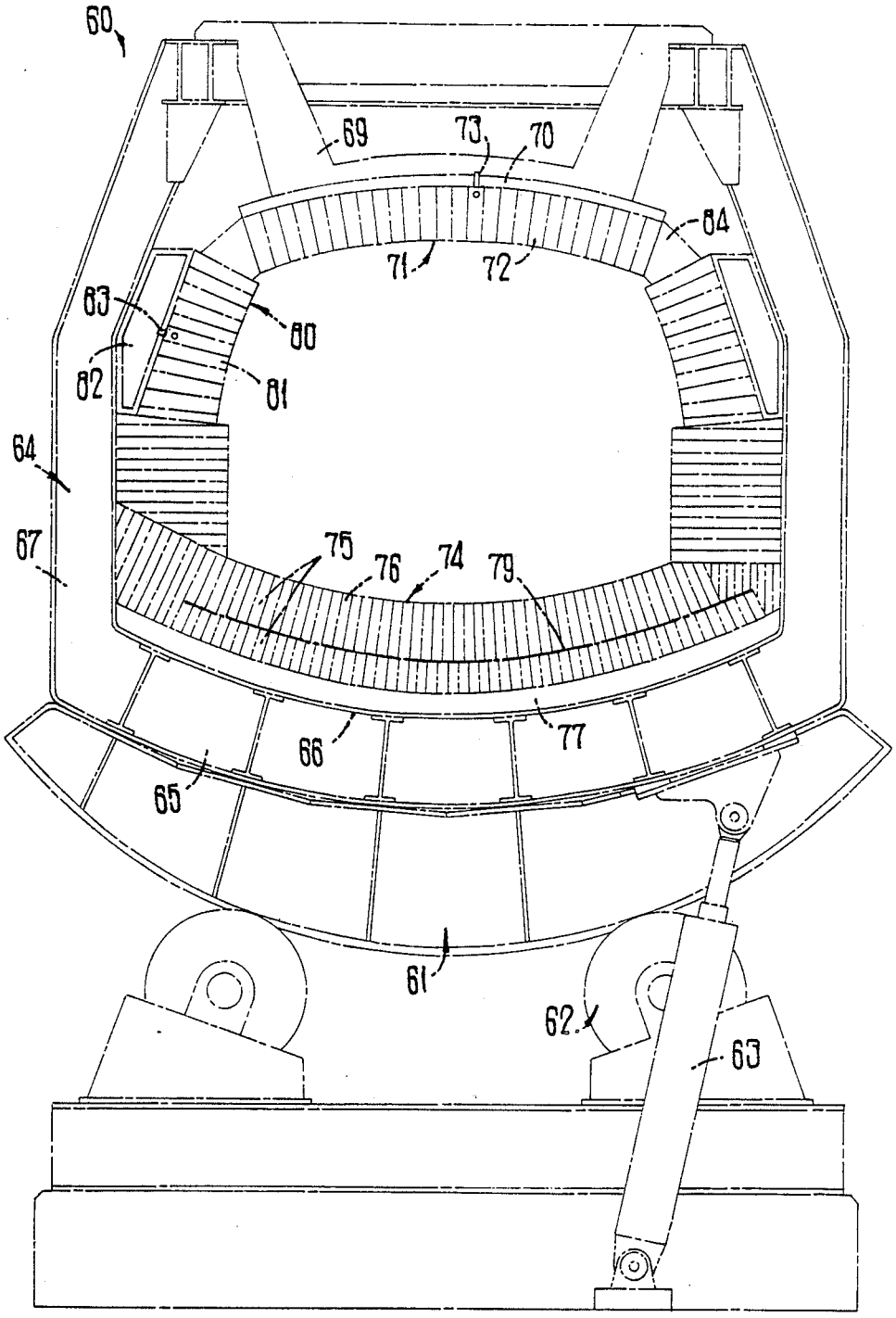
PRIOR ART FIG 2
FIG. 2 is a cross sectional view of a furnace of the prior art.

Before the description of the furnace 10 of this invention is completed, it becomes instructive to view a prior art furnace. FIG. 2 illustrates the construction of a prior art furnace designated generally by numeral 60. As can be seen in the drawing, a tilt follower beam 61 is supported by a plurality of rollers 62-62. A hydraulic cylinder 63 actuates a tilting motion of the furnace 60 to cause a slag layer contained inside the furnace 60 to be poured off or to empty a charge of molten material contained inside the furnace.

A structural frame 64 is mounted on and supported by the tilt follower beam 61 and is comprised of a hearth frame portion 65 which has an arcuate portion 66, a plurality of side frame portions 67-67, a plurality of sidewall beams 82-82 attached to the side frame portions 67-67 and a roof support portion 69 having an arcuate portion 70.

The furnace 60 also includes a roof portion 71 which is supported by the roof support portion 69 and which is comprised of a plurality of refractory bricks 72-72 attached to the arcuate portion 70 with hangers 73-73. Each hanger 73 may be similar if not identical to a hanger 50 shown in FIG. 6. A bottom portion 74 is comprised of a plurality of layers 75-75 of refractory bricks 76-76 and is supported by a hearth cover 77 which is in engagement with the arcuate portion 66. A steel sheet 79 is disposed between the layers 75-75. A sidewall portion 80 is comprised of a plurality of refractory bricks 81-81 attached to the sidewall beams 82-82 with a plurality of metal brackets 83-83. The sidewall portion 80 is disposed between the roof portion 71 and the bottom portion 74. A plurality of refractory key blocks 84-84 are disposed between the sidewall portion 80 and the roof portion 71.

Unlike the furnace 10 of this invention, the sidewall beams 82-82 of the prior art furnace are affixed rigidly to and are an integral part of the furnace structural frame 64. As such, the sidewall beams 82-82 are not removably mounted to the furnace structural frame 64. Refractory bricks 81-81 are removable only from the interior of furnace 60 because accessibility to the bricks is precluded by the structural frame 64. Further, removal of the bricks 81-81 requires a cooling down of the furnace 60 from an operating temperature typically in the range of 2000° F. Such cooling of the furnace 60 commonly results in thermal stress damage to other refractory portions thereof.

The problem of replacement or repair of worn or damaged sidewall portions of prior art furnaces has been overcome with the furnace of this invention. In the furnace 10, the sidewall portion 40 is constructed in a manner which facilitates repair without the need of cooling down the furnace to a temperature which enables the repair operation to be conducted from within the furnace. The sidewall portion 40 includes a plurality of modular sections 85-85 each including an external support stucture 86 and a refractory portion 87. In a preferred embodiment, the refractory portion 87 is comprised of a plurality of refractory bricks 88-88. Support of each modular section of the sidewall portion 40 is provided by a mechanical engagement 89. Each modular section 85 is secured to the frame 18 by a connective arrangement 90.

Figure 4:
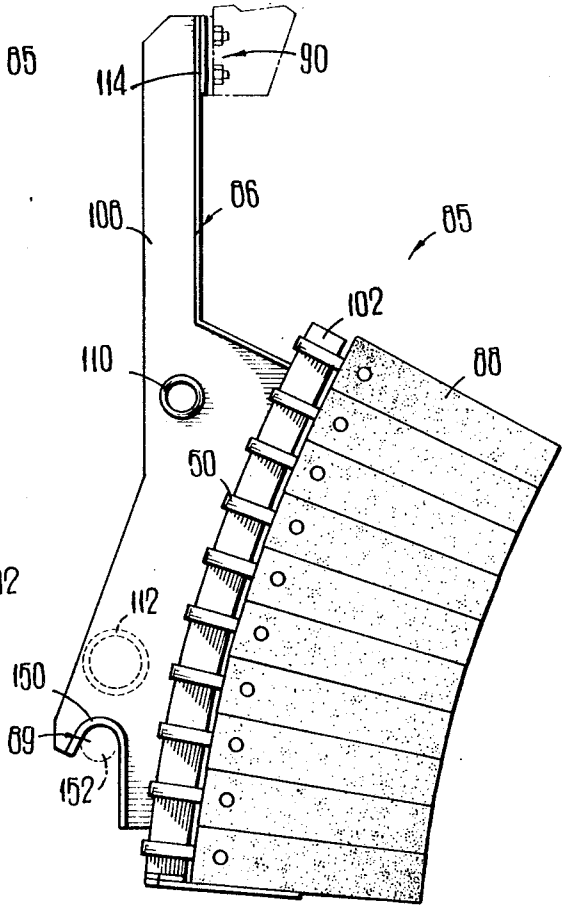
FIG. 4 is a side elevational view of the modular section of FIG. 3.
Figure 3:
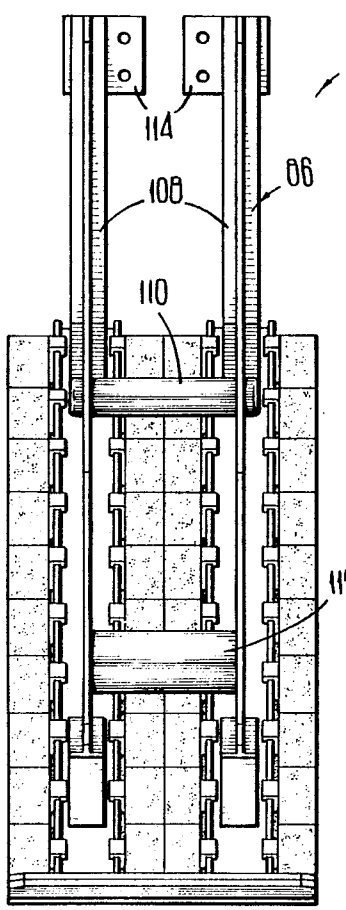
FIG. 3 is a front elevational view of a modular section comprised of a plurality of refractory brick.
Figure 6:
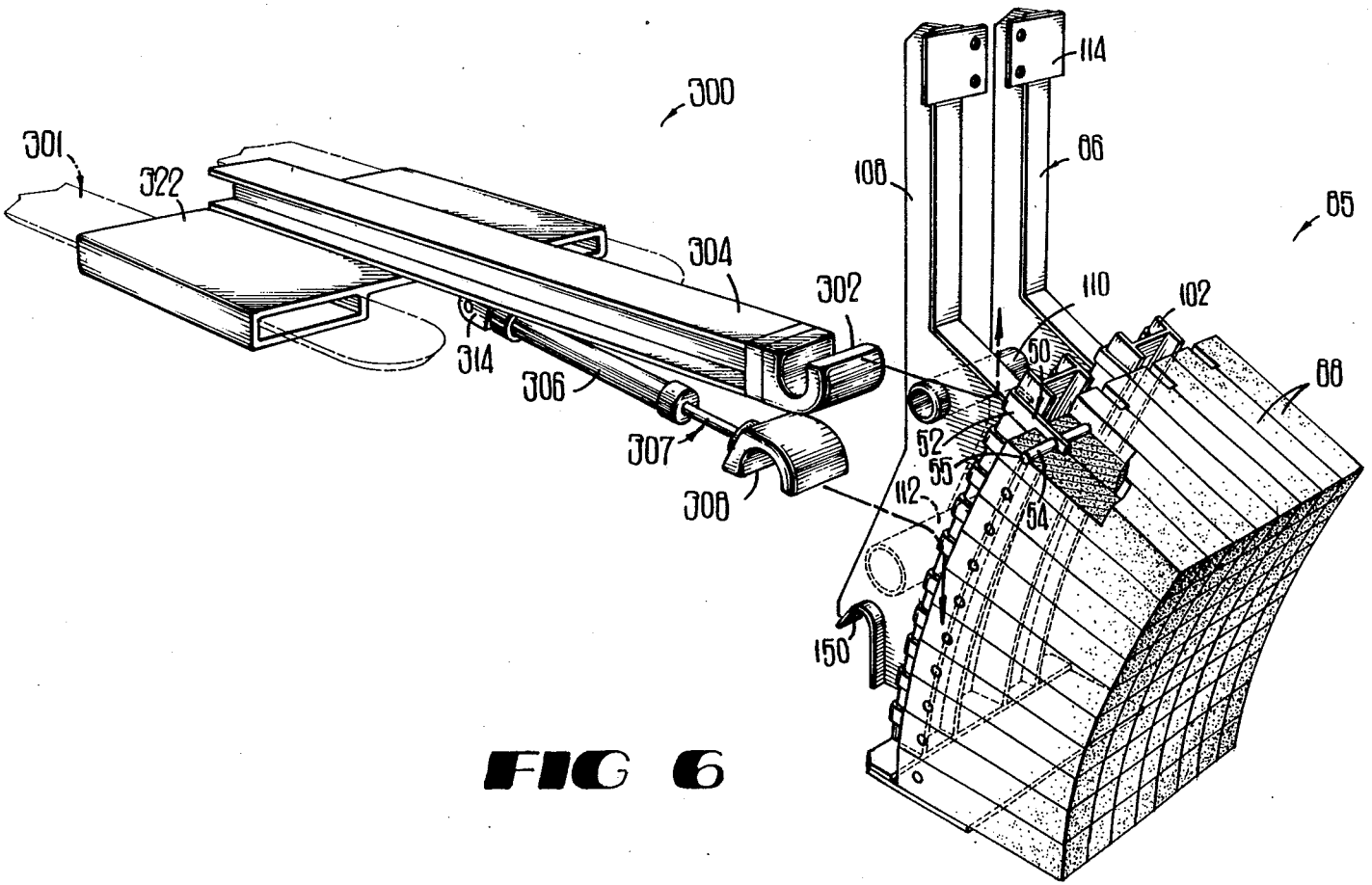
FIG. 6 is a perspective view depicting a step in the replacement of a modular section.

Viewing now FIGS. 3 and 4, there is shown a detailed view of one of the modular sections 85-85 which includes a plurality of refractory brick 88-88 attached to an arcuate portion 102 of an external support structure 86 by metal hangers 50-50 shown in FIG. 6. The external support structure 86 includes two spaced apart members 108-108 which are oriented vertically and two lift bars, an upper lift bar 110 and a lower lift bar 112. The lift bars span between the vertically oriented members 108-108.

As is shown in FIG. 1, the external support structure 86 of each modular section 85 is secured to the furnace structural frame 18 at two points of mechanical engagement. Viewing now FIG. 4, mechanical engagement 89 of a lowermost portion of the modular section with the furnace structural frame 18 is provided by a notch 150 provided at a lowermost portion of each vertical member 108 and is engaged with a support 152 attached to the furnace structural frame.

Mechanical engagement 90 of an upper portion 114 of the external support structure 86 is adjacent to a portion of the roof support beam 46 when the modular section 85 is set into position on the furnace 10 and is secured with mechanical fasteners.

Figure 5:
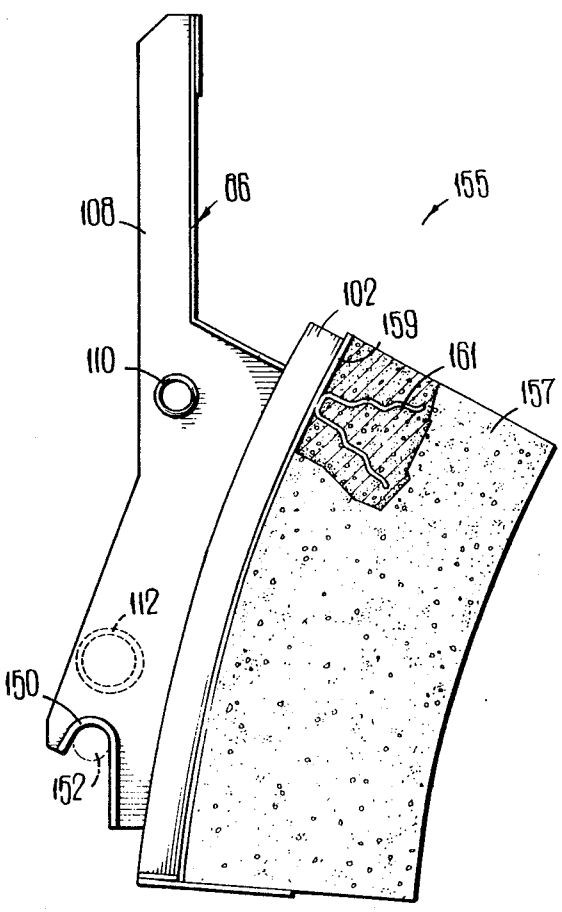
FIG. 5 is a side elevational view of a modular section comprised of a 20 cast, monolithic refractory element.

Referring now to FIG. 5, there is shown an alternate embodiment of a modular section. In the alternative embodiment, a modular section 155 comprises a cast, monolithic refractory element 157 secured to arcuate portion 159 of an external support structure 86 with metal anchors 161-161.

Viewing now FIG. 6, there is shown an external lift mechanism 300 positioned adjacent to a modular section 85 which is in need of replacement in preparation for removal of the modular section. The external lift mechanism 300 is engaged with fork lift forks 301-301 inserted through fork lift tubes 322-322. A lift bar 304 of the external lift mechanism is moved into position relative to the modular section 85 such that a support cradle 302 engages the upper lift bar 110 of the modular section. An articulating assembly 307 comprises a hydraulic cylinder 306 which is mounted pivotally about a pin 314 and an engaging block 308. The articulating assembly 307 is manually positioned such that the engaging block 308 engages the lower lift bar 112 of the modular section 85, such procedure requiring simultaneous pivotal motion of the articulating assembly 307 and extension or retraction of the hydraulic cylinder 306. With the articulating assembly 307 in engagement with the modular section 85 requiring replacement, the external lift mechanism 300 is controlled to remove the modular section from the sidewall 40.

With a replacement modular section 85 fully supported by the external lift mechanism 300, the modular section is caused to be positioned into a void in the sidewall portion 40 of the furnace 10 created by the prior removal of a modular section therefrom. A combination of movements of the fork lift forks 301-301 and extension or retraction of the hydraulic cylinder 306 may be necessary to cause engagement of the notch 150 with the support 152 (see FIG. 4). Further movement of the fork lift forks 301-301 may be necessary to provide the final connective engagement 90 whereafter the external lift mechanism 300 may be removed from engagement with the modular section 85.

It is to be understood that the above-described arrangements are simply illustrative of the invention. Other arrangements may be devised by those skilled in the art which will embody the principles of the invention and fall within the spirit and scope thereof.

We claim:

1. A furnace, comprising:

a frame; and a refractory lining which is attached to and supported by said frame, said refractory lining comprising:

a bottom portion which forms a leakproof reservoir for holding molten material;

a roof portion which is spaced above said bottom portion; and a sidewall portion which is disposed between said bottom portion and said roof portion and which comprises a plurality of modular sections which are capable of being removed individually without the need to enter the furnace to permit replacement of individual ones of the modular wall sections.

2. The furnace of claim 1, wherein each said modular section of said sidewall portion includes a plurality of refractory elements which are adhered together to help maintain said elements in the configuration of said modular section.

3. The furnace of claim 1, wherein each said modular section of said sidewall portion includes an external support structure which is supported by a portion of said frame adjacent to said bottom portion of said refractory lining.

4. The furnace of claim 3, wherein each said modular section includes a plurality of refractory elements which are adhered together and wherein said external support structure to which is attached the plurality of refractory elements of a modular section is mechanically secured to a portion of said frame adjacent to said roof portion.

5. The furnace of claim 1, wherein each said modular section of said sidewall portion of said refractory lining comprises a single cast, monolithic refractory element.

6. The furnace of claim 5, wherein said monolithic refractory element is attached to a portion of an external support structure with hangers.

7. The furnace of claim 6, wherein each said external support structure to which is attached a cast monolithic element is in mechanical engagement with a portion of said frame adjacent to said bottom portion.

8. The furnace of claim 6, wherein each external support structure to which is attached a modular section which comprises a cast monolithic element is mechanically secured to another portion of said frame adjacent to said roof portion.

9. A method of repairing a furnace, said method comprising the steps of:

providing a furnace which includes a frame, a bottom refractory portion for holding molten material, a roof refractory portion which is positioned above the bottom portion and a sidewall refractory portion which is disposed between the bottom portion and the roof portion and which comprises a plurality of modular refractory sections which are capable of being removed individually without the need to enter the furnace to permit replacement of individual modular wall sections;

from a position external to the furnace, applying forces to a modular section which is in need of replacement to remove the modular section which is in need of replacement from the sidewall portion; and installing a replacement modular section in place of the removed modular section.

10. The method of claim 9, wherein said method is capable of being performed when the furnace is at an elevated temperature.

11. The method of claim 9, wherein said method is performed when the furnace is at room temperature.

12. The method of claim 9, wherein the modular section is removed by the steps of:

disengaging securing means associated with an external support structure of the modular section to which refractory portions are attached from the frame adjacent to the roof portion;

applying a force to the external support structure to facilitate removal of the modular section which is in need of replacement from juxtaposition with adjacent modular sections; and removing the modular section which is in need of replacement from the furnace.

13. The method of claim 9, wherein removing force is provided by an external mechanical device which is attached temporarily to the external support structure of the modular refractory section which is in need of replacement.

* * * * *